US007059495B1

(12) United States Patent
Williamson et al.

(10) Patent No.: US 7,059,495 B1
(45) Date of Patent: Jun. 13, 2006

(54) SINGLE PERIODICAL DISPENSING DEVICE

(76) Inventors: Jeffery A. Williamson, 2215 Brookhaven Dr., Alma, AR (US) 72921; John S. Fowler, Jr., 18393 Old State Hwy. 112, Poteau, OK (US) 74953

( * ) Notice: Subject to any disclaimer, the term of this patent is extended or adjusted under 35 U.S.C. 154(b) by 216 days.

(21) Appl. No.: 10/772,680

(22) Filed: Feb. 5, 2004

(51) Int. Cl.
*B65H 3/00* (2006.01)

(52) U.S. Cl. ..... 221/191

(58) Field of Classification Search ..... 221/226, 221/191

See application file for complete search history.

(56) References Cited

U.S. PATENT DOCUMENTS 3,912,124 A * 10/1975 Pinkerton ..... 221/298
4,257,531 A * 3/1981 Kimura et al. ..... 221/227
4,298,140 A * 11/1981 Owens ..... 221/232
4,667,803 A * 5/1987 Gordon ..... 194/248
5,067,605 A * 11/1991 Gordon ..... 194/248

* cited by examiner

*Primary Examiner*—Gene O. Crawford
*Assistant Examiner*—Timothy Waggoner
(74) *Attorney, Agent, or Firm*—Head, Johnson & Kachigian

(57) ABSTRACT

A periodical dispensing device combines a camming mechanism and an article engaging blade to separate a single article from a horizontal stack. When actuated, the separated article is released through a dispensing chute. The stacked articles are dispensed through a chute one at a time. Newspapers, periodicals and other flexible articles may be used with the device.

7 Claims, 8 Drawing Sheets

Left View

SINGLE PERIODICAL DISPENSING DEVICE

BACKGROUND OF THE INVENTION

1. Field of the Invention

The present invention relates to an apparatus and method for dispensing flexible objects one at a time. Specifically, the apparatus and method dispenses newspapers, magazines and other periodicals one at a time in order to conserve paper and operate more efficiently.

2. Prior Art

Newspaper dispensing machines have been in existence for many years. Many persons rely upon these rather than daily delivery to their doors in order to obtain a newspaper. Although there are a variety of designs for these newspaper dispensing machines, they all operate on the same basic principle.

A person desiring a newspaper places the required amount of change into a slot in the newspaper machine. A door is then automatically unlocked. The operator then opens the door and grabs the newspaper on top of a stack within the device. This design allows an operator to grab as many newspapers as he or she desires while only paying for a single one. Newspaper companies have always relied on the honor system to deter persons from taking more than one newspaper. Unfortunately, the honor system is not always effective. Often a person will take two or more newspapers to share with others. In addition, teenage children often pay for a single newspaper and take the entire stack of newspapers for use in scurrilous activities, such as spreading them across a person's lawn. This same problem exists with similar devices designed to distribute magazines, pamphlets and other flexible objects such as various periodicals.

It is therefore desirable to provide an apparatus and method for dispensing a single newspaper or other periodical one at a time and not allowing the operator access to all the newspapers or periodicals within the dispensing device.

SUMMARY OF THE INVENTION

The present invention provides an apparatus and method for dispensing a single newspaper or other periodical one at a time so as to prevent an operator from removing the entire stock of newspapers or periodicals within the dispensing device. After the operator dispenses the appropriate amount of money into the device, the dispensing mechanism is released and may be operated. The operator pulls on a lever causing a single newspaper to fall out of a chute.

The device holds the newspapers stacked horizontally. They are held together firmly between a blocking plate at the front of the stack and a spring or weight loaded push plate at the back of the stack. As newspapers are dispensed, the push plate applies pressure to the back of the newspaper stack to insure that the stack remains firmly held against the block plate.

The dispensing mechanism is better understood by explaining the mechanism from the point at which an operator releases the handle after having just pulled it outward. The handle is also weight loaded and retracts automatically. The handle is attached to a blade assembly. The blade assembly consists of a trap plate which is a flat, planar object. A padded blade is pivotally attached to the trap plate by means of the blade assembly. The blade is a long, thin planar body positioned vertically and has rollers or cams on either side of it. These cams or rollers fit within polygonal cam tracks located on either side of the blade. When the handle retracts causing the blade plate to retract into the device the rollers or cams follow the cam track and cause the blade to move in an upward motion as it goes further into the interior of the apparatus. The padded blade frictionally engages the foremost newspaper within the newspaper holding bin. As it moves upward, it pulls the newspaper slightly upward and over a toe that otherwise holds the newspapers in place.

The next time the handle is pulled outward by a subsequent operator, the blade is pulled away from the foremost newspaper, thereby disengaging it. In the absence of the frictional force applied to it by the blade, a newspaper freely falls downward. In between the toe and the trap plate is a relatively narrow opening leading into a chute. The newspaper falls through the chute and is thereby dispensed to the operator. Once the second operator disengages the handle, the handle and trap plate retract. This causes the blade to once again frictionally engage the next foremost newspaper and lift it above the restraining toe. The newspaper is then ready to be dropped through the chute the next time the handle is pulled outward.

As is explained in more detail below, the stack of newspapers is held snugly between the push plate and the block plate and restraining toe. The blade preferably has a rubber or other coating that increases the friction between it and the foremost newspaper. The blade moves upward as it pushes against the foremost newspaper, thereby pulling it over the restraining toe and holding it just above the dispensing chute. When the handle is pulled outward, the blade disengages the newspaper which then falls through the chute.

The motion of the blade is directed by the movement of the cam through the cam track. When the handle retracts, the cam track moves the cam in a backward and upward angled direction. When the handle is pulled outward the cam track guides the cam and blade forward and then downward. The interaction of the cam, cam track and blade is one of the unique features of the invention that allows a single newspaper or other item to be separated from the remaining articles within the device.

DETAILED DESCRIPTION OF THE PREFERRED EMBODIMENTS

The embodiments discussed herein are merely illustrative of specific manners in which to make and use the invention and are not to be interpreted as limiting the scope of the instant invention.

While the invention has been described with a certain degree of particularity, it is to be noted that many modifications may be made in the details of the invention's construction and the arrangement of its components without departing from the spirit and scope of this disclosure. It is understood that the invention is not limited to the embodiments set forth herein for purposes of exemplification.

In the present invention, a stack of newspapers or other periodicals is placed in a tray and stacked horizontally. A plate pushes against the back of the stack to hold it firmly. Another plate at the front and top of the stack along with a toe at the bottom of the front of the stack help to hold the stack in place. At the front of the stack is a blade. When a handle at the front of the device is released, the blade pushes against the newspaper at the top of the stack and pushes it slightly upward so that the bottom of the newspaper rises above the toe. When the handle is pulled, the blade moves away from the stack and the topmost newspaper is released. Because the toe is no longer holding the bottom of the newspaper in place, the newspaper falls into a dispensing chute from which it may be retrieved. The operation of the device may be more clearly understood by referring to the figures.

Figure 1:
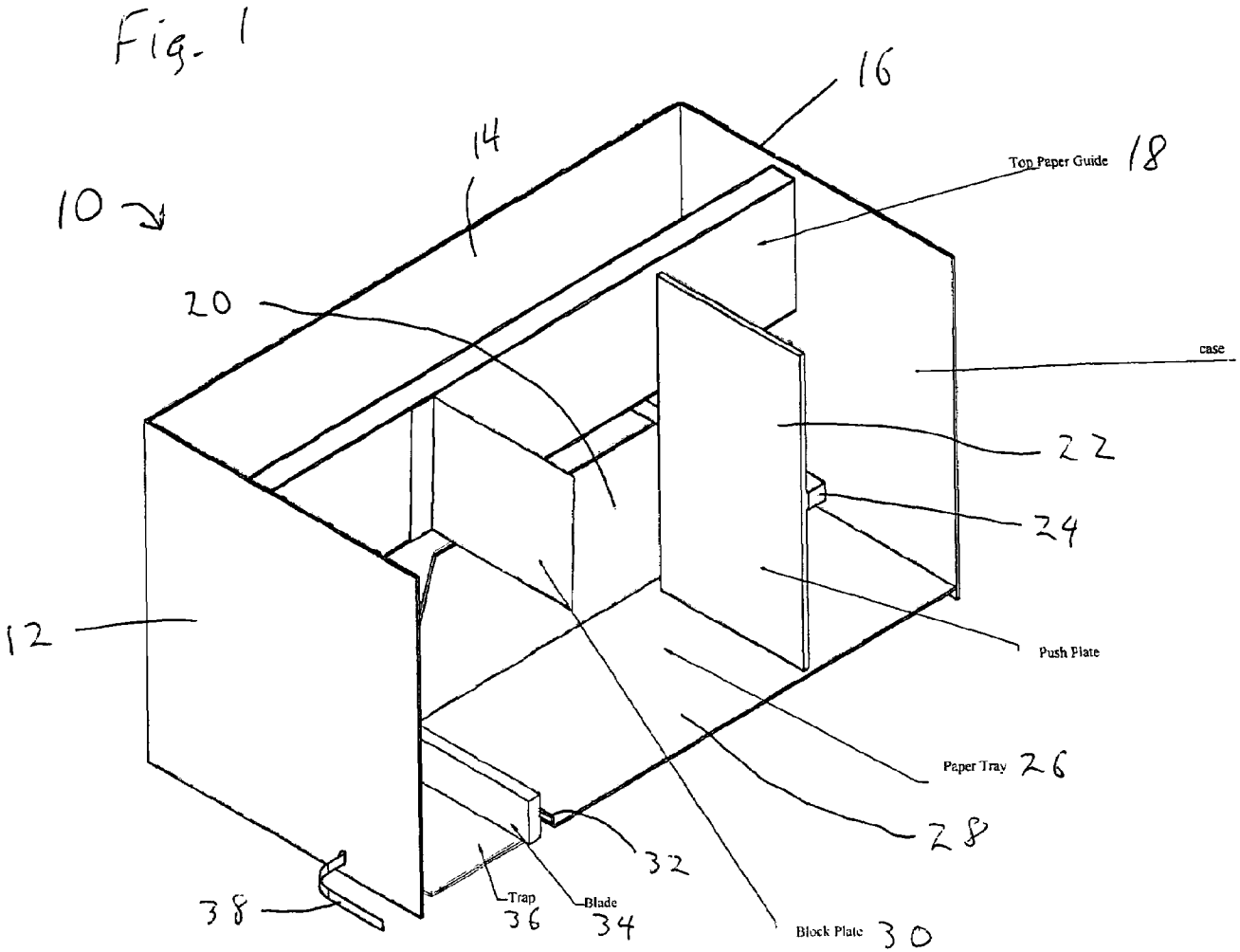
FIG. 1 is a cut-away perspective view of the present invention.

FIG. 1 shows a perspective cut-away image of the present invention. Dispensing apparatus 10 has a front 12, a side 14 and a back 16. In this image, approximately half of the device is shown. A second half that is a mirror image of what is shown is included in the entire device. Paper tray 26 has a bottom plate 28, a top tray guide 18 and a lower tray guide 20. A stack of newspapers is pushed against block plate 30 and toe 32 by push plate 22. The front of the newspaper stack is held in place by push plate 22, block plate 30 and toe 32. Handle 38 is attached to trap plate 36. As will be shown in more detail in the later figures, the trap plate 36 is moveably attached to blade 34.

Figure 2:
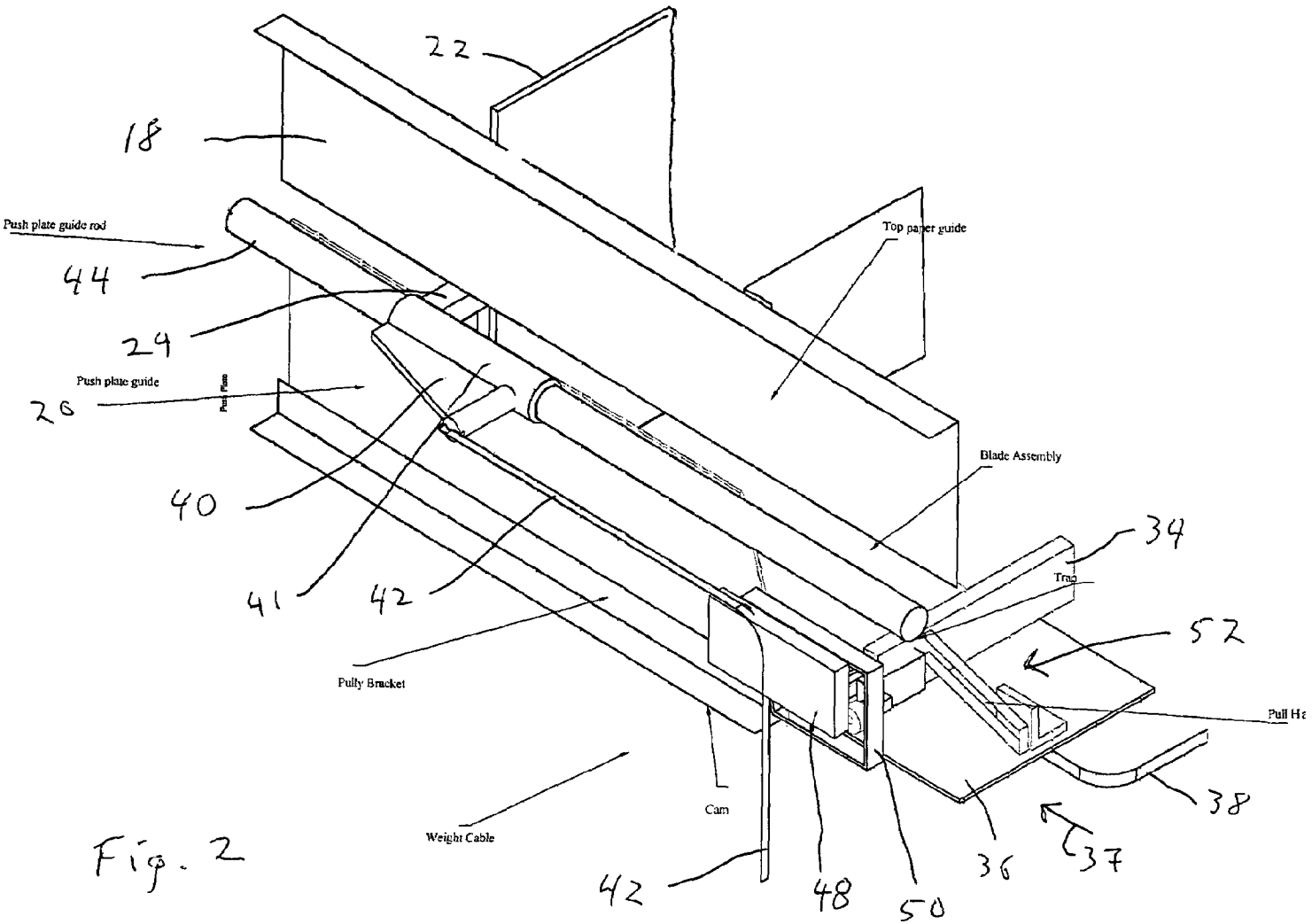
FIG. 2 is a cut-away perspective view of the invention from a different angle.

FIG. 2 shows a perspective view from another angle of the paper tray and dispensing mechanism. Top paper guide 18 and bottom paper guide 20 help hold the stack in place. Push plate 22 is attached to push plate guide 40 by support bar 24. Push plate guide 40 consists of a cylinder 41 that wraps around guide rod 44. To ensure smooth motion, push plate guide rod 44 is preferably lubricated. Weight cable 42 is attached to a weight (not shown) and rolls around a pulley inside pulley bracket 48. Weight cable 42 pulls push plate guide 40 in a forward direction thereby pulling push plate 42 forward in order to apply pressure to the back of the paper stack. In this particular embodiment, push plate guide 40 moves along guide rod 44 by means of a cylinder 41 that surrounds the guide rod. Those skilled in the art will appreciate that the push plate guide may also run along the guide rod by means of a roller or any of a variety of other methods known in the art. Those skilled in the art will also appreciate that a weight and a weight cable may also be replaced with the variety of other methods of applying forward pressure to back plate 22. Springs may also be used as well as a motor. A weight and weight cable are typically preferred because strings will wear out and motors require energy and may break down.

In FIG. 2 blade assembly 52 may be seen. Blade assembly 52 moveably attaches blade 34 to trap plate 36 and will be shown in more detail in FIG. 6. Cam track 50 may also be seen. Cam track 50 guides the movement of blade 34 as will also be seen in FIG. 6. Another weight cable and weight is typically applied to trap plate 36 to apply sufficient pressure to pull trap plate in the direction of directional arrow 37. When handle 38 is pulled, trap plate 36 moves in the opposite direction of directional arrow 37. When the handle 38 is released, the trap plate moves back into the device. This back and forth motion of trap plate 36 is transferred to blade 34 by means of blade assembly 52. When the motion is transferred the movement of blade 34 is guided by cam track 50.

Figure 3:
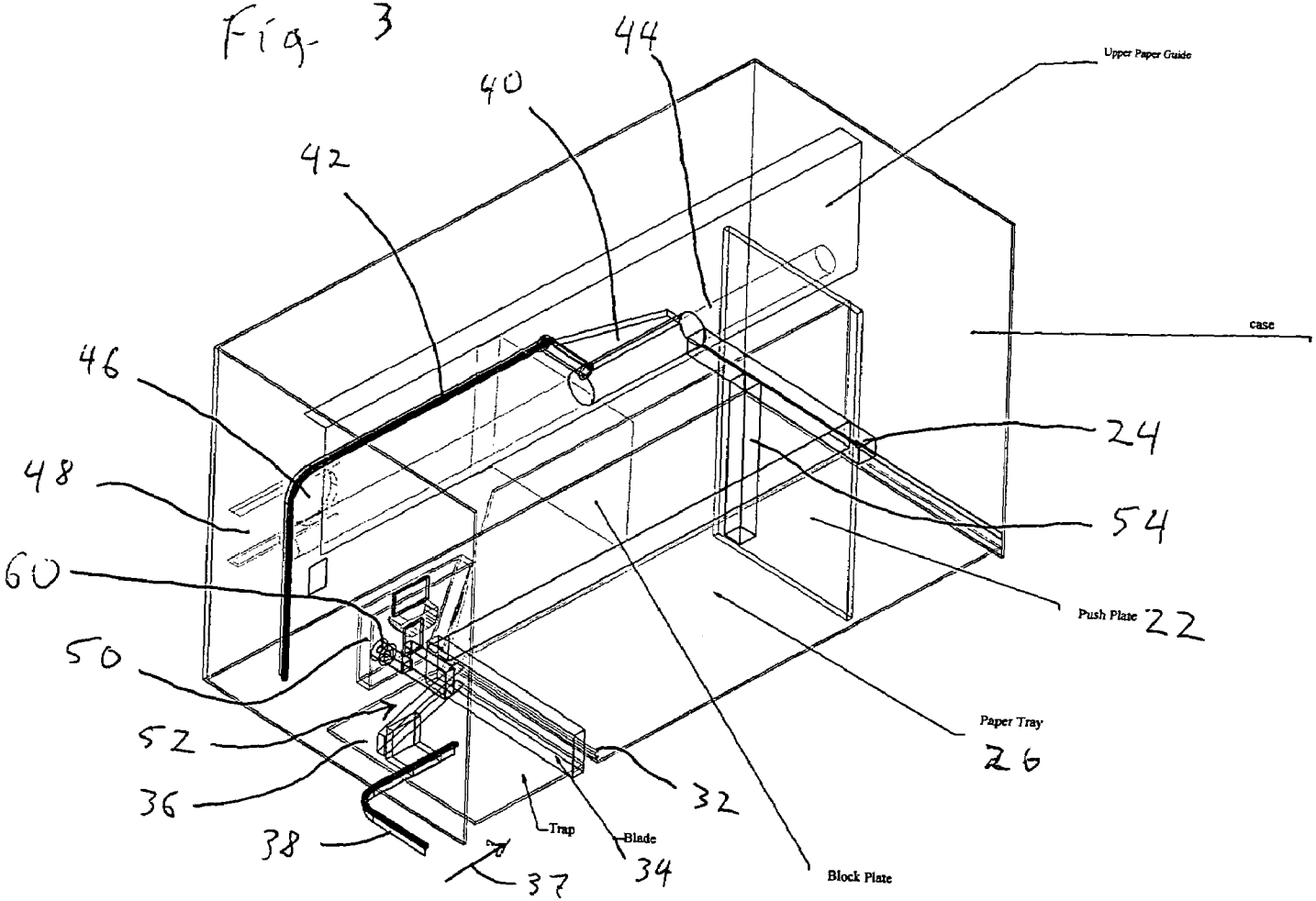
FIG. 3 is a phantom view of a portion of the invention.

FIG. 3 shows a phantom image of the invention. Here it can be seen how weight cable 42 engages pulley 46 inside pulley bracket 48. Push plate support stanchion 54 may also be seen. In this embodiment, only one support stanchion is shown. However, those skilled in the art will appreciate that it may be desirable to utilize multiple support stanchions to support push plate 22. In this image, cam track 50 may also be seen. Cam 60 is inside cam track 50. It can be seen that when trap plate 36 moves in the direction of directional arrow 37, bracket assembly 52 will transfer the motion to blade 34. Blade 34 is attached to cam 60. As cam 60 moves backward in cam track 50, it is pushed upward. This upward motion is transferred to blade 34 such that blade 34 begins to move in an upward direction approximately the time it contacts a newspaper at the front of a stack in paper tray 26. This upward motion is transferred to the newspaper because blade 34 frictionally engages the paper at the front of the stack. This upward motion pulls the front newspaper over toe 32. When handle 38 is used to move trap plate 36 forward in a direction opposite to that of directional arrow 37, the movement is transferred by blade assembly 52 and is guided by cam 60 in cam track 50 which causes blade 34 to move away from the newspaper which has been lifted over toe 32. Without the frictional engagement of blade 34 to hold the top newspaper in place, it falls into the space between blade 34 and toe 32 and drops into a dispensing chute.

Figure 4:
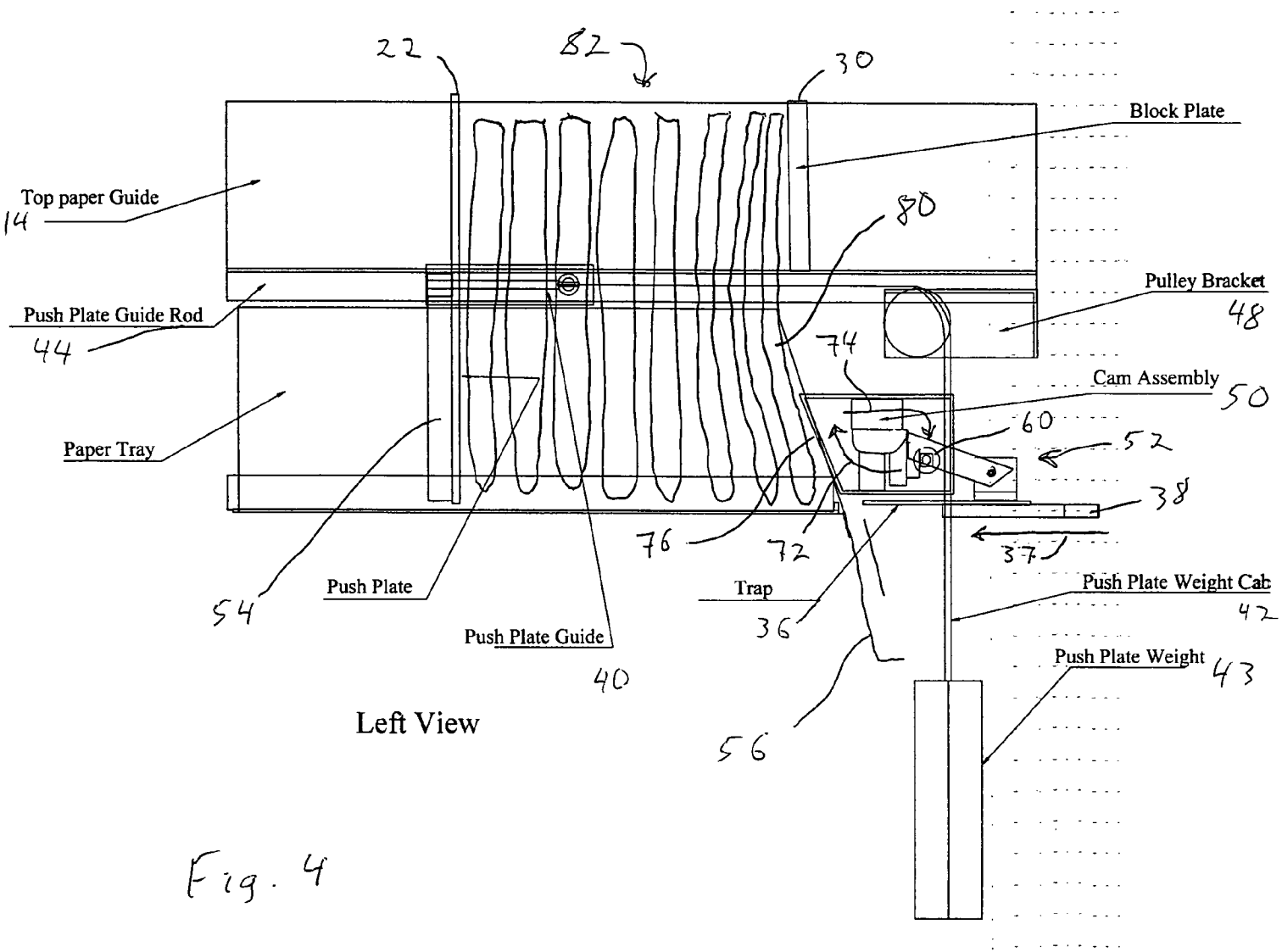
FIG. 4 is a side phantom view of the present invention.

FIG. 4 shows a left side view of the invention. In this figure push plate weight 43 can be seen attached to the end of weight cable 42. The shape of cam track 50 can also be seen. Back portion 76 of cam track 50 is angled such that when cam 60 follows directional arrow 72 through cam track 50 the blade is caused to move forward and upward. This motion causes front newspaper 80 to become frictionally engaged to blade 34 and causes the paper to move up and over toe 32. When cam 60 moves through cam track 50 by the route shown by directional arrow 74, the blade disengages front paper 80 and allows it to drop into chute 56. The next paper in stack 82 is then ready to be dispensed. Weights, springs or other devices known in the art are used to apply force to trap plate 36 in the direction of directional arrow 37 such that first paper 80 is held in place above the chute until handle 38 is pulled in the direction opposite of directional arrow 37. A mechanism not shown prevents handle 38 from being pulled until an appropriate amount of money is deposited into the machine. Such devices are well known in the art.

Figure 5:
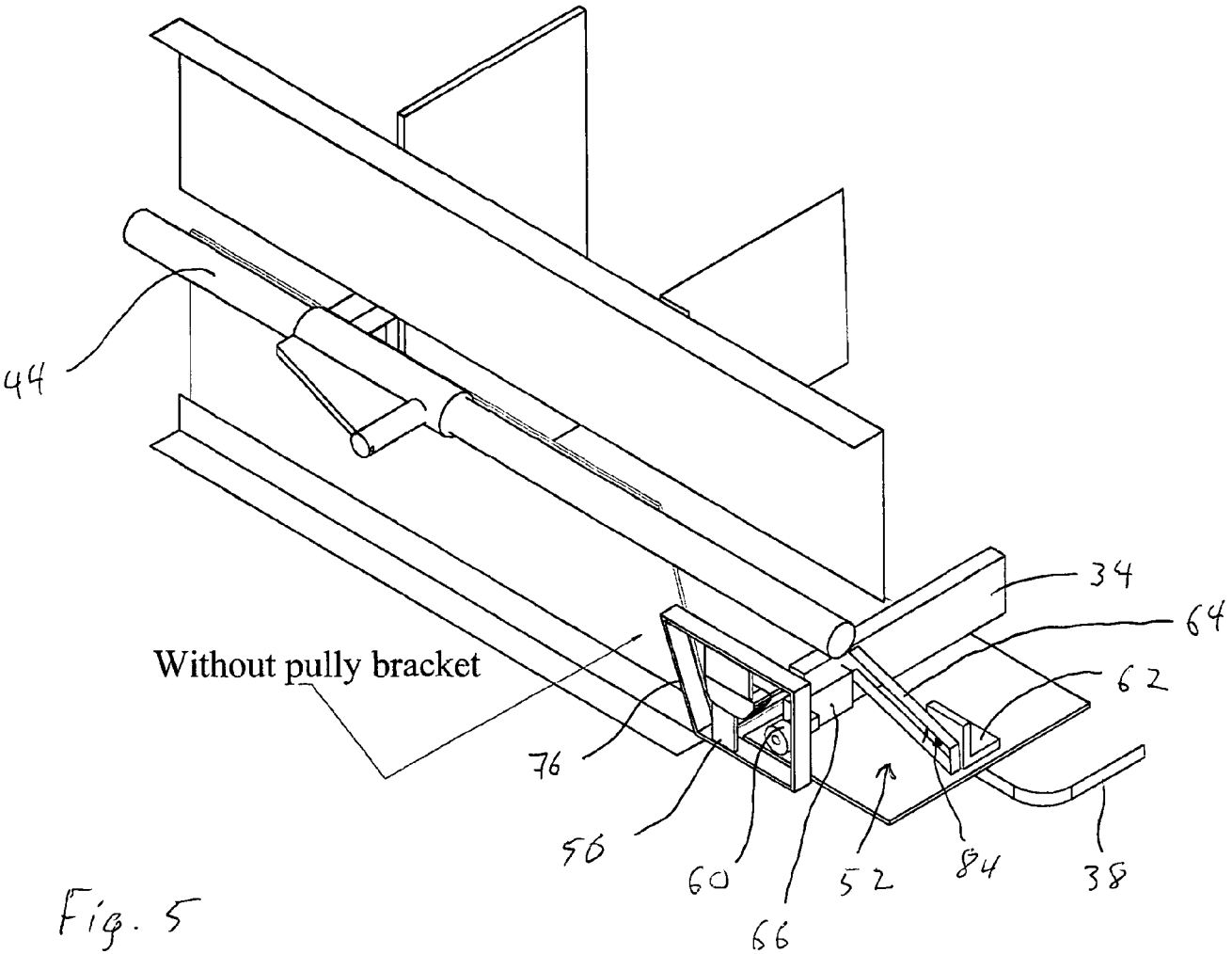
FIG. 5 is a cut-away perspective view of a portion of the present invention.

FIG. 5 shows a perspective view of the invention that shows brackets 66 connecting blade 34 to cam 60. Pivot pin 84 connects base 62 to blade rod 64 in such a way that it may pivot about pivot pin 84. This allows the back and forth motion of trap plate 36 to be converted into a more circular-type motion of blade 34 as it is guided by the motion of cam 60 through cam track 50.

Figure 6:
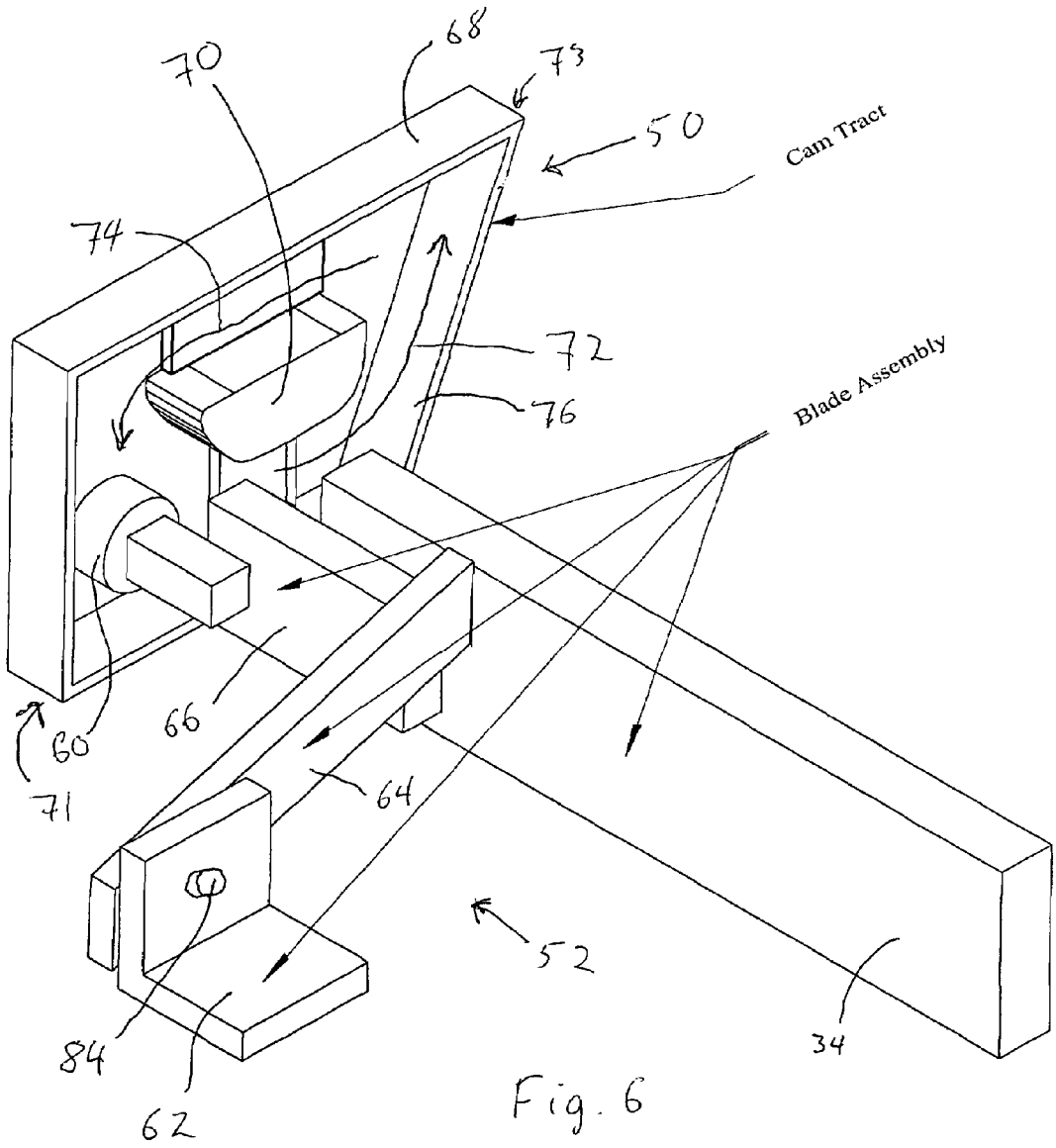
FIG. 6 is a perspective view of the blade assembly and cam track of the present invention.

FIG. 6 is a perspective view of the blade assembly and cam track 50. As cam 60 moves through cam track 50 following directional arrow 72, blade rod 64 tilts upward as it pivots about pivot pin 84 while blade 34 moves in an upward direction. Cam track 50 is formed by track outer wall 68 and inside wall 70. Between these two walls is sufficient room for cam 60 to move. The two walls 68 and 70 form a track that is mostly rectangular except for back wall 76 which is angled. Those skilled in the art will appreciate that the upward and backward motion of the blade caused by cam 60 moving in the direction of directional arrow 72 is what allows the blade to engage a newspaper and lift it over the toe. Cam track 50 does not need to be angular about its front portion 71. However, it is preferable that corner 73 is angled such that the force causing the assembly to move in the direction of directional arrow 37 will hold the cam and thus the blade in place when the device is not in use. This prevents a newspaper from being released without money being deposited and the handle pulled.

Figure 7:
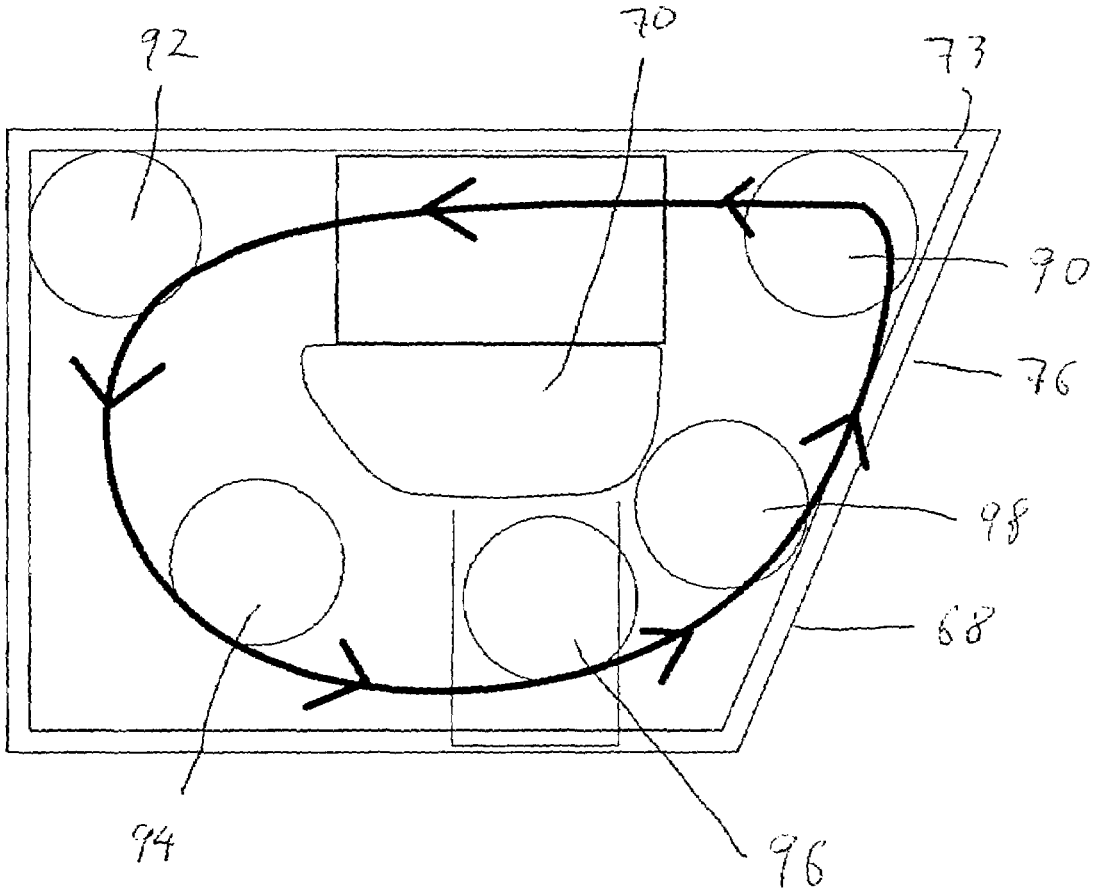
FIG. 7 is a side view of the cam track.

FIG. 7 shows the motion of cam 60 as it moves about the cam track. The cam is normally at rest in position 90 in corner 73. As explained previously, while in this position it holds the blade in a position such that a newspaper is ready to be dispensed. When the handle is pulled, the cam moves to position 92 thereby releasing a newspaper suspended above a chute by the blade. The force of gravity causes the cam to then fall into position 94. When the handle is released, the pressure applied to the track plate causes the cam to move to position 96, then to position 98. The angle of back wall 76 causes the cam to return to position 90. As shown in the other figures, this causes the blade to move in the same fashion, thereby frictionally engaging the next newspaper in the stack and lifting it above the toe. The paper is then suspended and ready to be released as the prior one was.

Figure 8:
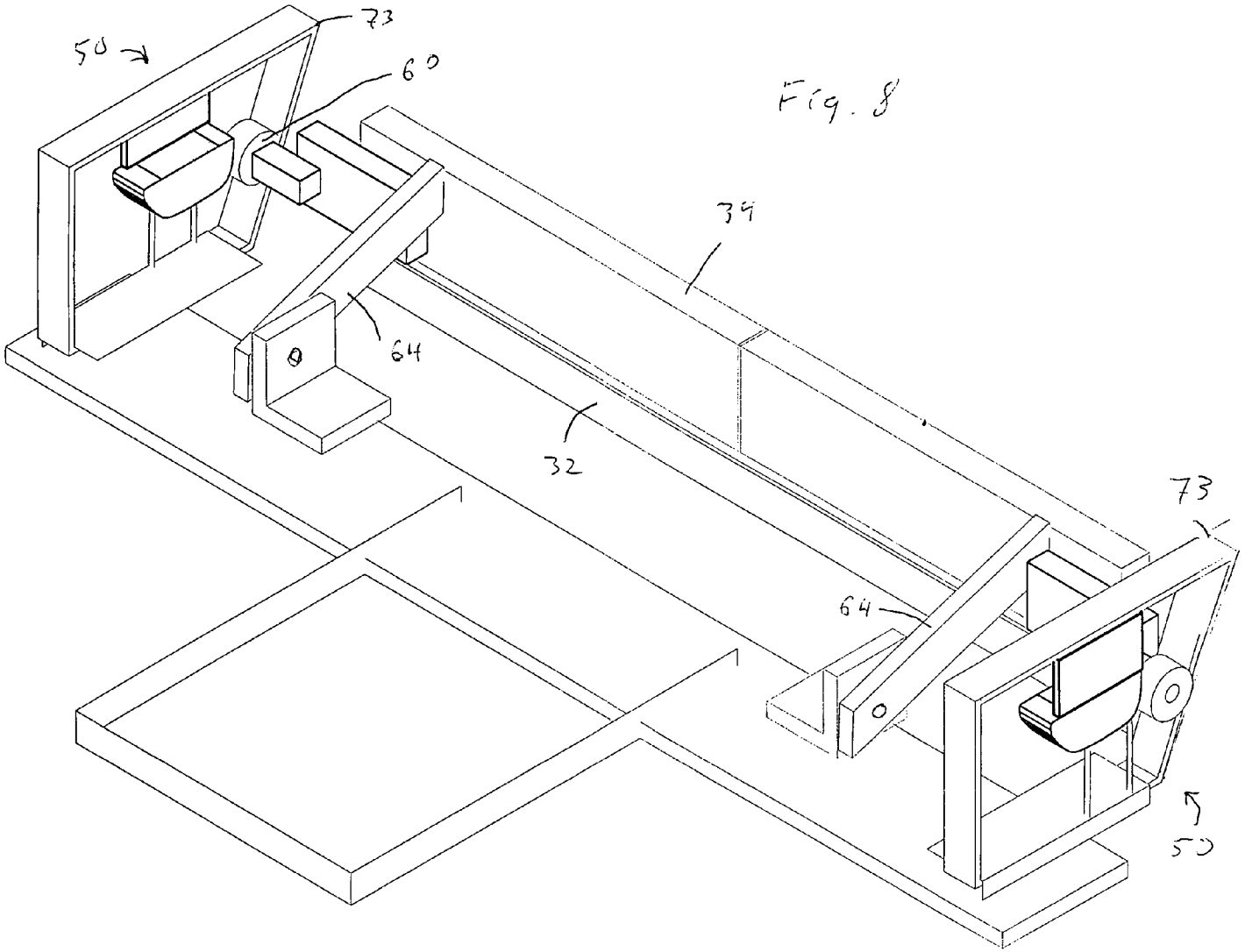
FIG. 8 is a perspective view of the blade assembly and cam track of the present invention.

FIG. 8 shows the change in position of blade 34 and movement of cam 60 into position 98 as shown in FIG. 7. As can be seen in FIG. 8, movement of cam 60 to position 98 and toward corner 73 causes blade 34 to move above and to the rear of toe 32. Those skilled in the art will appreciate that this will cause blade 34 to frictionally engage a newspaper or other flexible article and will result in it being lifted above toe 32.

Whereas, the present invention has been described in relation to the drawings attached hereto, it should be understood that other and further modifications, apart from those shown or suggested herein, may be made within the spirit and scope of this invention.

What is claimed is:

1. A periodical dispensing device comprising:

a paper tray capable of retaining a horizontal stack of periodicals and comprising two sides, a rear push plate, a front upper block plate and a lower front toe;

a trap plate having a handle;

a blade assembly comprising a base, a pivot pin and a blade rod;

a periodical lifting blade that is pivotally attached to the trap plate by the blade assembly;

at least one cam attached to the paper lifting blade;

at least one cam track;

wherein the trap plate is capable of backward and forward motion;

wherein the cam is engaged with the cam track in a way such that when the trap plate is moved in the backward direction, the motion is transferred through the blade assembly to the blade and the engagement of the cam with the cam track causes the paper lifting blade to move in an upward and backward direction such that the blade frictionally engages a periodical at the front of the stack; and wherein the engagement of a cam to the cam track causes motion transferred to the blade by forward motion of the trap plate to cause the blade to move first in a backward and then downward direction, thereby releasing the periodical at the front of the stack.

2. The device of claim 1 wherein a load is applied to the trap plate to create a bias in the backward direction.

3. The device of claim 1 wherein the push plate has a load applied to it so as to bias it in the forward direction.

4. The device of claim 2 wherein the load is applied by means of a weight and a weight cable.

5. The device of claim 3 wherein the load is applied by means of a weight and a weight cable.

6. The device of claim 1 further comprising a dispensing chute.

7. A method for dispensing periodicals one at a time comprising:

horizontally stacking periodicals between a back push plate, a front block plate and a front toe;

applying force against the stack through the back push plate;

Using a horizontal motion to apply a blade, guided by a cam track, to the front of the front periodical of the stack such that it frictionally engages a periodical at the front of the stack and pushes it upward so that the toe no longer holds the periodical in place in the stack; and disengaging the frictional attachment of the blade so as to allow the front periodical of the stack to be released from said stack and thereby dispensed.

* * * * *